US005816955A

United States Patent [19]

Nordgran et al.

[11] Patent Number: 5,816,955

[45] Date of Patent: Oct. 6, 1998

[54] APPARATUS FOR FLEXIBLY MOUNTING A BASKETBALL GOAL

[75] Inventors: Richard C. Nordgran, Roy; David C. Winter, Layton, both of Utah

[73] Assignee: Lifetime Products, Inc., Clearfield, Utah

[21] Appl. No.: 846,672

[22] Filed: Apr. 30, 1997

[51] Int. Cl.[6] ..... A63B 63/08

[52] U.S. Cl. ..... 473/486

[58] Field of Search ..... 473/486, 481, 473/484; 411/400

[56] References Cited

U.S. PATENT DOCUMENTS

| | | | |
|---|---|---|---|
| 418,503 | 12/1889 | Crane . | |
| 1,253,961 | 1/1918 | Grimsrud . | |
| 1,811,987 | 6/1931 | Wales . | |
| 2,742,843 | 4/1956 | Redetzke | 97/198 |
| 2,881,003 | 4/1959 | Drew | 473/484 |
| 2,935,144 | 5/1960 | Graham | 172/265 |
| 3,462,143 | 8/1969 | Bidelman et al. | 273/1.5 |
| 4,111,420 | 9/1978 | Tyner | 273/1.5 |
| 4,151,989 | 5/1979 | Dittrich | 273/1.5 |
| 4,194,734 | 3/1980 | Tyner | 273/1.5 |
| 4,320,896 | 3/1982 | Engle et al. | 273/1.5 |
| 4,348,022 | 9/1982 | O'Donnell | 273/1.5 |
| 4,365,802 | 12/1982 | Ehrat | 273/1.5 |
| 4,377,283 | 3/1983 | Mahoney | 273/1.5 |
| 4,433,839 | 2/1984 | Simonseth | 273/1.5 |
| 4,438,923 | 3/1984 | Engle et al. | 273/1.5 |
| 4,441,709 | 4/1984 | Schroeder et al. | 273/1.5 |
| 4,465,277 | 8/1984 | Dittrich | 273/1.5 |
| 4,483,534 | 11/1984 | O'Donnell | 273/1.5 |
| 4,534,556 | 8/1985 | Estlund et al. | 273/1.5 |
| 4,575,079 | 3/1986 | De Faveri | 273/1.5 |
| 4,583,732 | 4/1986 | Allen | 273/1.5 |
| 4,846,469 | 7/1989 | Nye | 273/1.5 |
| 4,926,953 | 5/1990 | Platt | 411/400 X |
| 5,255,910 | 10/1993 | Simonseth | 473/481 |

OTHER PUBLICATIONS

"Our All–Star Lineup" Equipment Catalog, Huffy Sports, Waukesha, Wisconsin, p. 4 (insert). Date Unknown.

"Portable Basketball System Assembly and Operating Instructions," Porter Athletic Equipment Company, Broadview, Illinois. Date Unknown.

Slam–Dunk Rim, Inc. Business Reply Mailing, Slam–Dunk Rim, Inc., Bellingham, Washington. Date Unknown.

"Slam–It Goal Instructions" Assembly Instruction Booklet, Lifetime Products, Inc., Clearfield, Utah. Date Unknown.

"Slam–It Goal" Promotion Material, Lifetime Products, Inc., Clearfield, Utah. Date Unknown.

"Standard Basketball Goals" Promotion Material, Porter Athletic Equipment Company, Broadview, Illinois. Date Unknown.

*Primary Examiner*—William H. Grieb

*Attorney, Agent, or Firm*—Madson & Metcalf

[57] ABSTRACT

A mechanism for flexibly mounting a basketball goal to a backboard to permit the goal to retractably break away from the backboard if a force exceeding a threshold force is applied to the goal. The mechanism has at least one flexible mount disposed near the lower portion of the mounting plate of the goal which secures the lower portion of the mounting plate in flexible connection to the backboard. This flexible mount permits pivoting of the goal away from the backboard about a point near the lower portion of the mounting plate. The mechanism also has a biased mounting assembly disposed near the upper portion of the mounting plate and securing the upper portion of the mounting plate in biased abutment to the backboard. This biased mounting assembly is connected to the backboard in pivotal engagement to permit the upper portion of the mounting plate to separate from the backboard along a substantially arc-shaped path as the goal pivots about the point near the lower portion of the mounting plate. The biased mounting assembly has a pivotally mounted bolt, a pair of nuts, and a pair of springs, wherein each of the nuts secures at least one of the springs around a pivotally mounted bolt in abutment with the mounting plate. Due to the pivoting of the pivotally mounted bolt, damage to the backboard, goal, and pivotally mounted bolt is minimized or eliminated while maintaining a reliable break away ability.

24 Claims, 4 Drawing Sheets

APPARATUS FOR FLEXIBLY MOUNTING A BASKETBALL GOAL

BACKGROUND OF THE INVENTION

1. The Field of the Invention

The present invention relates to an apparatus for flexibly mounting a basketball goal to a basketball backboard such that when a threshold force is applied to the basketball goal, the mounting apparatus will absorb much of the energy applied to the goal by the impact of that force by allowing the goal to break away retractably from the backboard.

2. The Background of the Art

In recent years it has become increasingly popular to "dunk" the basketball. This involves throwing the basketball through the basketball goal from a position above the rim of the goal. While it is possible to dunk the basketball without the basketball or the player touching the rim during the process, it is not uncommon for a player to strike the rim with the basketball or with his arms or to suspend himself from the rim of the goal after releasing the basketball, thereby imparting substantial dynamic forces to the goal.

If the force applied to the basketball rim is of sufficient magnitude, many problems could result. For example, at one time it was popular to construct basketball backboards from glass. Thus, it was not uncommon for a player to shatter the glass backboard as a result of the force applied to the goal while dunking the basketball. This was extremely disadvantageous in that it resulted in a possibility of injury to players surrounding the goal as well as to spectators in the immediate area. This was additionally disadvantageous in that the backboard had to be replaced before the game could resume. Replacing a glass backboard requires a substantial amount of time. Therefore, when a glass backboard was broken, it resulted in an unacceptable delay of the basketball game. It can also be prohibitively expensive to replace glass backboards each time they are damaged. Although most glass backboards have been replaced today with backboards made of materials which are more resistant to shattering, it is still desirable to eliminate the possibility of damage to the backboard which may result from the force applied to the basketball goal when a player dunks the basketball.

Not only is it possible to break or deform a backboard by dunking the basketball, but it is also possible to bend or otherwise destroy the basketball goal itself by applying a substantial force to the goal. Although the goals used for professional or organized basketball games are constructed to be very durable, many goals sold for backyard or playground use are not of such durable construction. Once a goal has been permanently deformed due to the impact of forces applied to it by repeated dunking of the basketball, it is very difficult, if not impossible, to restore the goal to its original, horizontal position. Thus, the goal usually must be replaced, thereby resulting in an undesirable expense to the owner.

Several attempts have been made to eliminate the problems mentioned above. What appears to be the universally accepted solution to the problem is to employ an apparatus which will allow the basketball goal to "break away" from its original horizontal position when a threshold force is applied to the goal. The apparatus allows the goal to break away retractably from the backboard while absorbing a substantial amount of the energy imparted to the goal from the impact of the force. An apparatus such as this allows the goal to maintain its horizontal position during regular play when only minimal forces are applied to it, such as the force of the basketball bouncing off of the goal. However, when a substantial force is applied to the goal, such as one resulting from someone dunking the basketball or suspending from the rim, the mounting apparatus will allow the goal to be broken away from the backboard thereby absorbing much of the energy imparted to the goal by the impact of that force.

Although many attempts have been made to successfully provide a break-away goal which solves the problems mentioned above, these attempts do not provide the most efficient solution to the problem. For example, one of the major disadvantages of one prior art apparatus is that it cannot be used on an existing basketball goal and backboard. Many of the prior art devices are constructed to be an integral part of the basketball goal. Thus, in order to use these prior art devices, it is necessary to purchase an entirely new basketball goal thereby rendering useless the existing goal. Accordingly, these prior art devices can only be obtained at a substantial expense to the purchaser.

A further disadvantage of many other prior art breakaway goals is that they tend to be of a very complex nature. As with most mechanical apparatus, complexity results in several disadvantages. First, the break-away apparatus of such prior art goals are expensive to manufacture, resulting in an increased price to the consumer. Apparatus of a complex nature also utilize more parts, which usually leads to a greater frequency of failure of the apparatus. Apparatus of a complex nature may also be difficult to install, as well as difficult to repair when a failure does occur.

Additionally, many of the apparatus of the prior art are constructed of materials which are not suitable for outdoor use or extended exposure to the elements.

It will be appreciated, therefore, that what is needed in the art is an apparatus for enabling a standard basketball goal to be converted into a break-away goal capable of breaking away from the backboard when a threshold force is applied to it, wherein such conversion is accomplished through retrofitting the apparatus to the basketball goal and backboard.

It would be an advancement in the art to provide an apparatus as described above which is constructed of materials which are of a durable nature to withstand harsh weather conditions which can result from continued outdoor use of a basketball goal.

It would also be an advancement in the art to provide an apparatus as described above which could be economically produced and easily assembled.

BRIEF SUMMARY AND OBJECTS OF THE INVENTION

The present invention includes a novel apparatus for flexibly mounting a basketball goal to a basketball backboard so that the goal may break away from the backboard when a threshold force is applied to the goal. More particularly, the apparatus of the present invention dissipates much of the energy applied to the goal by the impact of the threshold force, thereby protecting the goal and the backboard from being damaged.

The apparatus of the present invention has two types of mounting means, a biased mounting means and a flexible mounting means. These mounting means are employed to hold a rim portion of a basketball goal horizontal and a mounting plate of the goal in a position biased against the backboard or other rigid support member. One or more biased mounting means are used to secure the upper portion of the mounting plate of the basketball goal in abutment to the backboard, while one or more flexible mounting means are used to secure the lower portion of the mounting plate of the goal to the backboard.

In one embodiment, each biased mounting means comprises a spring secured about one leg of a U-shaped bolt. The U-shaped bolt is pivotally mounted to a fixed mounting bracket behind the backboard. Thus, the mounting plate of the basketball goal is biased towards and against the backboard. Accordingly, when a threshold force is applied to the basketball goal and against the biasing, the spring is compressed and the mounting plate breaks away from its resting position of abutment and moves away from the backboard along an arcuate path.

In a further embodiment, a spring of each biased mounting means is secured with a J-shaped bolt to the mounting plate of the basketball goal. The J-shaped bolt is, in turn, pivotally mounted to the fixed mounting bracket behind the backboard.

Each flexible mounting means has a resilient ring that absorbs force when the basketball goal is broken away from the backboard. The ring permits the goal to pivot about a movable point near the lower portion of the mounting plate as the goal breaks away from the backboard. Thus, upon application of the threshold force to the basketball goal, the upper portion of the mounting plate compresses the springs on the biased mounting means and allows the upper portion of the mounting plate to separate from the backboard. The lower portion of the mounting plate acts on the resilient ring of the flexible mounting means which provides sufficient flexibility at the lower portion of the mounting plate so that the goal may pivot about a movable point near the lower portion of the mounting plate.

When a threshold force is applied to the basketball goal, the compression of the spring of the biased mounting means and the compression of the ring of the flexible mounting means serve to dissipate a substantial amount of the energy transmitted through the basketball goal from the impact of the threshold force. The energy is absorbed by the spring and ring rather than by the basketball goal and backboard. Hence, the likelihood of damaging the basketball goal or the backboard by applying a substantial force to the basketball goal is significantly reduced.

Accordingly, the present invention provides an apparatus for protecting the basketball goal and backboard from being damaged when a substantial force is applied to the basketball goal, thereby reducing the possibility of injuries to players and spectators resulting from shattered glass backboards, eliminating the delay resulting from having to replace a basketball goal or backboard which is damaged, and eliminating the expense of making these repairs.

The present invention further provides an apparatus which allows the basketball goal to break away from the backboard thereby reducing the possibility of injury to players which may result from dunking a basketball through a rigid goal.

The present invention also provides an apparatus which secures the goal in its desired horizontal disposition until a threshold force is applied to the goal which causes the mounting plate to break away from the backboard.

The present invention enables retrofit conversion of a standard basketball goal and backboard into a break-away goal capable of breaking away from the backboard when a threshold force is applied to the goal and returning to its normal horizontal disposition when the force is released.

The present invention additionally provides a mounting apparatus as described above which is simple to install and can be economically manufactured.

These and other advantages of the invention will become apparent upon reading the following detailed description and appended claims, and upon reference to the accompanying drawings.

DETAILED DESCRIPTION OF THE PREFERRED EMBODIMENTS

Figure 1:
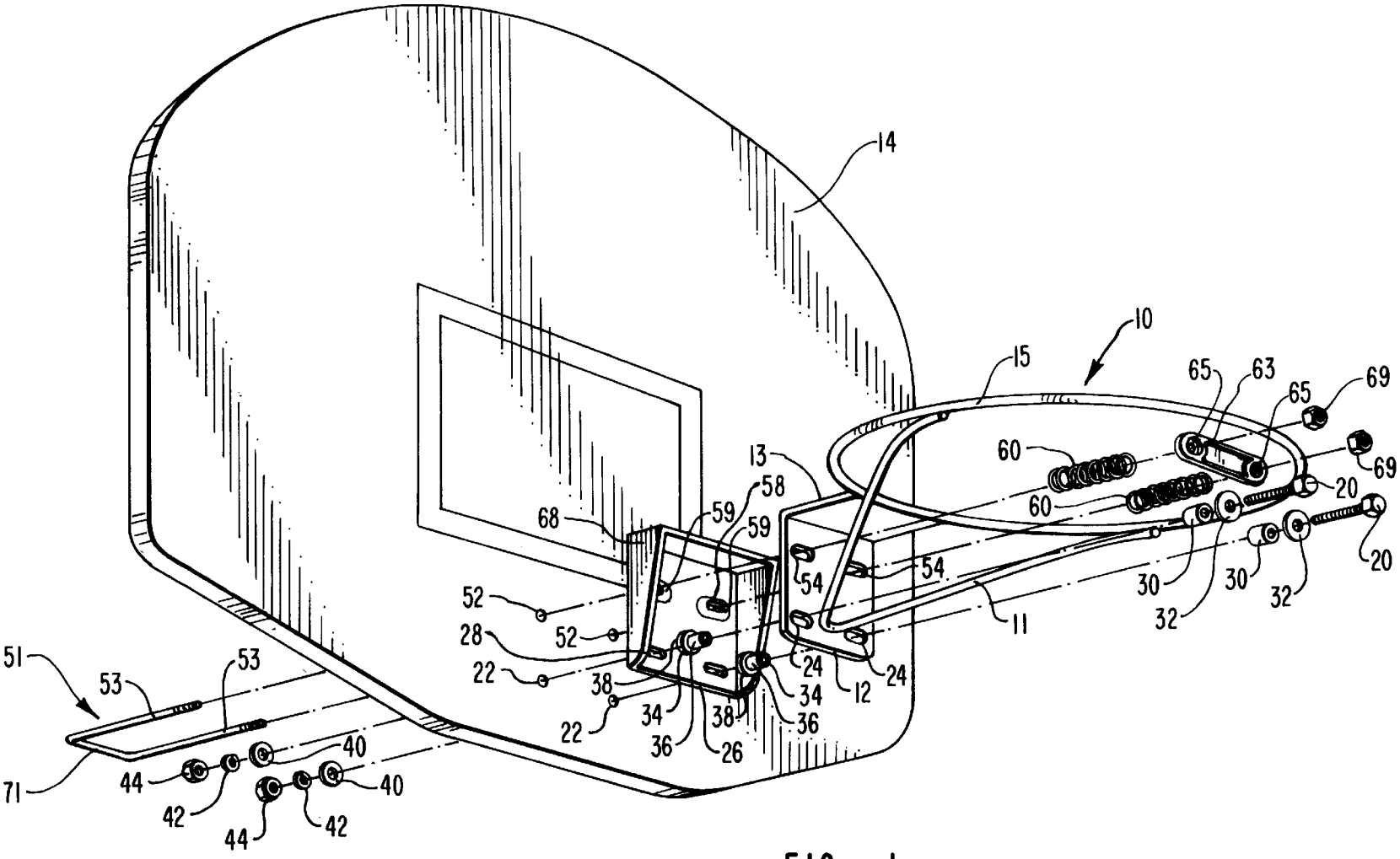
FIG. 1 is an exploded perspective view of the present invention showing the disposition of various components, including a U-shaped bolt, used for flexibly mounting a standard basketball goal to a conventional backboard.

The present invention is directed to an apparatus for flexibly mounting a basketball goal to a backboard such that when a threshold force is applied to the goal, such as might be applied to the goal when someone dunks the basketball and/or suspends from the rim, the goal retractably breaks away from the backboard. In this manner, much of the energy from the impact of the force applied to the goal is dissipated without damage to the goal or backboard.

The forces which are most destructive to a goal are usually applied to the goal primarily in a downward direction. It is not uncommon to see a goal mounted to a backboard which is bent to a position below the horizontal. With the present invention, however, the goal does not bend or permanently deform, but the mounting apparatus allows the entire goal to rotate into a broken-away position while dissipating much of the energy transferred to the goal by the impact of the force applied to the goal. When this force is no longer applied to the goal, the goal returns to the horizontal position where it remains rigidly mounted to the backboard during regular use until another threshold force is applied to the goal causing it again to break away from the backboard. Thus, it can be seen that the mounting apparatus of the present invention protects the goal and the backboard from damage which may result from the impact of large forces being applied to the goal.

As used herein, a "threshold force" is any force which, when applied to the basketball goal, is sufficient to cause breaking away of the goal from the backboard. As will be further explained below, the present invention may be adjusted such that the threshold force may be increased or decreased as desired; that is, the mounting apparatus may be adjusted such that a greater or lesser force is required to be applied to the goal before the goal will break away from the backboard.

In the preferred embodiment of the invention, the apparatus should be adjusted such that the goal will not break away during regular use, that is, when the only forces acting upon the goal are those resulting from the basketball striking the goal when those using the goal attempt to make a basket. However, when those using the goal dunk the basketball or hang from the net or rim of the goal, the forces applied to the goal are often substantially greater than those applied to the goal when someone hits the goal with the basketball while shooting baskets. Use of the goal wherein forces are imparted to the goal which are greater than those resulting from shooting baskets, especially forces of sufficient magnitude to damage the goal or backboard or injure a player attempting to dunk the basketball, is beyond the scope of "regular use" as that term is used herein.

The threshold force is greater than any force applied to the goal during regular use because under conditions of regular use, the goal should react as though it is rigidly mounted to the backboard. If the goal were allowed to break away during regular use, the basketball would react differently when it strikes the goal than it would when striking a goal that is rigidly mounted to a backboard.

The threshold force should not be so high that a force applied to the goal would bend or otherwise damage the goal or backboard before the threshold force is reached. Thus, the threshold force should be set so that the goal will break away from the backboard when a force sufficient to damage the goal or backboard is applied to the goal, and so that the goal will not break away from the backboard during regular use. There may be a wide range of forces that falls between the two extremes outlined above. The determination of where the threshold force is set within that range is a matter of preference to those using the goal.

Reference is now made to the figures wherein like parts are referenced by like numerals throughout. With particular reference to FIG. 1, the present invention is used to mount a goal 10 having a mounting plate 12 to a backboard 14 or other rigid support member. The goal 10 comprises a rim brace 11, the mounting plate 12, a horizontal plate 13, and a circular rim 15. The mounting plate 12 of the goal 10 is perpendicular to the plane in which the rim 15 and the horizontal plate 13 lie, and the mounting plate 12 extends downwardly from that plane. The mounting plate 12 has an upper portion and a lower portion. The rigid support member can be a standard basketball backboard 14, as illustrated in FIGS. 1 and 2, or may comprise some other rigid support to which the backboard 14 and the conventional goal 10 are mounted.

Figure 2:
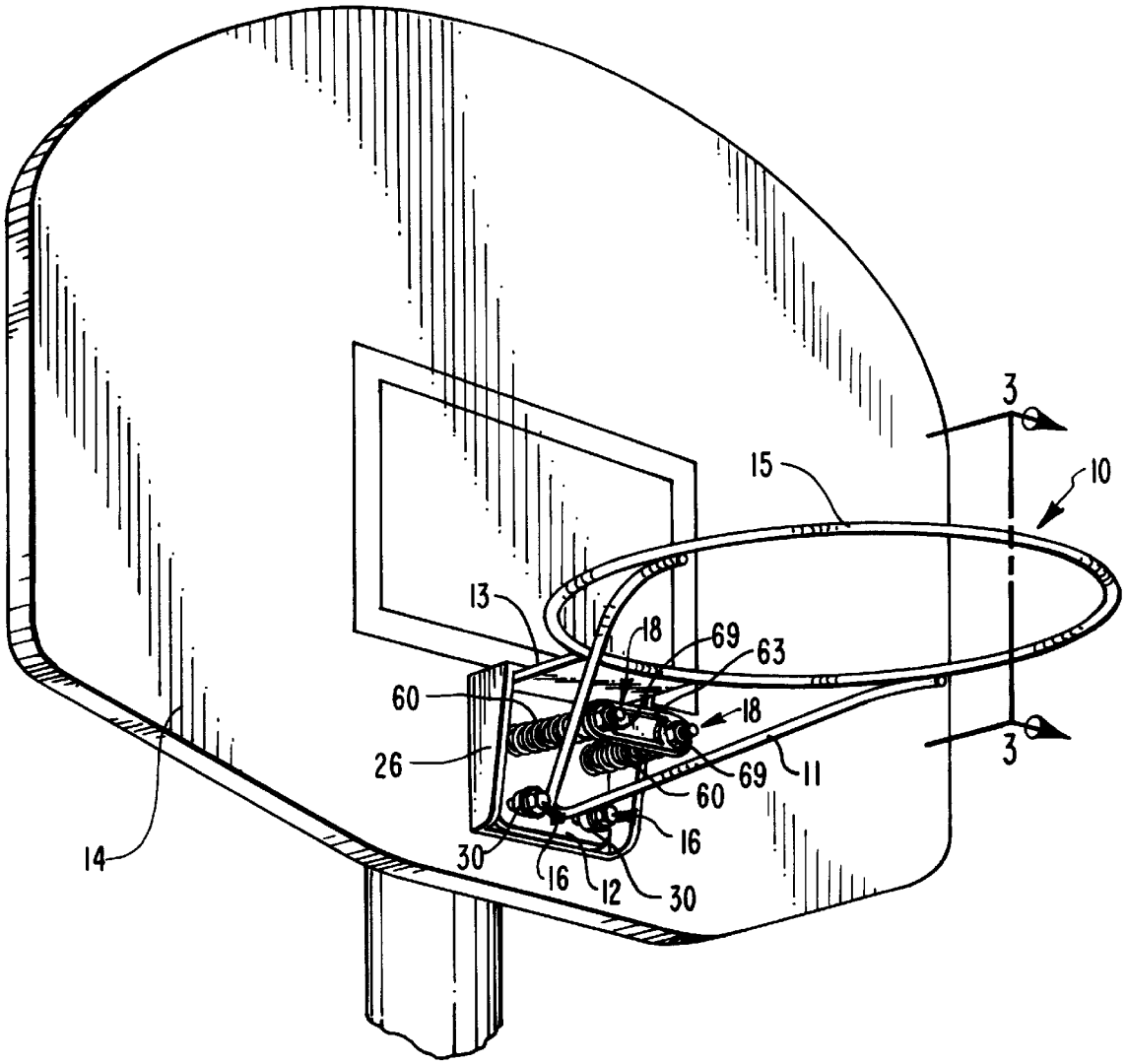
FIG. 2 is a perspective view of the present invention as it is used to flexibly mount a standard basketball goal to a conventional backboard.

As can best be observed in FIG. 2, the apparatus of the present invention comprises at least two mounting means, a flexible mounting means 16 and a biased mounting means 18. Because the present invention is designed for use in retrofitting a goal 10 to a backboard 14 thereby converting the rigidly mounted goal 10 into a break-away goal 10, the number of flexible mounting means 16 and biased mounting means 18 employed is governed by the bolt pattern on the goal 10 and backboard 14. For example, the bolt pattern shown on the backboard 14 in FIG. 1 is typical in that it has four holes spaced in a rectangular configuration. Thus, for this particular bolt pattern, two flexible mounting means 16 and two biased mounting means 18 may be used, as can be best seen by reference to FIG. 2.

When the goal 10 breaks away from the backboard 14, as will be more fully described later, the goal 10 deflects in a substantially arcuate path about a movable axis near the lower portion of the mounting plate 12. It is the combination of the biased mounting means 18 used to secure the upper portion of the mounting plate 12 to the backboard 14 with the flexible mounting means 16 used to secure the lower portion of the mounting plate 12 to the backboard 14 which allows the goal 10 to break away from the backboard 14. Thus, a flexible mounting means 16 could be used in each hole in the lower portion of the mounting plate 12 and a biased mounting means 18 could be used in each hole in the upper portion of the mounting plate 12.

It will be appreciated that among the many commercially available goals, there are many variations in basic structure. For example, while most goals 10 have a rim brace 11 which is welded or otherwise attached to the mounting plate 12 of the goal 10 at a point along the line intersecting the mounting holes in the lower portion of the mounting plate 12, some do not. Some goals are configured such that the rim braces 11 are welded to the mounting plate 12 of the goal 10 at a point slightly above or below the line intersecting the lower mounting holes in the mounting plate 12. While the advantages of the present invention are best realized when used with a goal having the rim brace 11 attached to the mounting plate 12 along the line intersecting the lower mounting holes in the mounting plate 12, the present invention will also function if the rim braces 11 are affixed to the mounting plate 12 slightly above or slightly below the line intersecting the lower mounting holes in the mounting plate 12.

Although, as mentioned above, most bolt patterns comprise four holes in a rectangular configuration, some bolt patterns may differ in the number of holes they provide or in the configuration of the holes. The present invention may be used to retrofit any goal 10 to any backboard 14 so long as the bolt pattern provides two holes in the upper portion of the mounting plate 12 for use with a biased mounting means 18 and at least one hole in the lower portion of the mounting plate 12 for use with a flexible mounting means 16. It is also necessary that the goal 10 be configured such that any rim brace 11 does not extend over any of the holes in the bolt pattern thereby preventing the flexible mounting means 16 or the biased mounting means 18 from extending outwardly from the hole.

Each flexible mounting means 16 comprises a threaded bolt 20 (see FIG. 1) which fits through a lower mounting hole 24 in the lower portion of the mounting plate 12 and through a lower mounting hole 22 in the rigid support member or backboard 14. The orientation of the bolt 20 is not critical to the correct operation of the break-away mounting apparatus, but it is preferred that the head of bolt 20 be on the side of the mounting plate 12, as shown in FIG. 1, to facilitate assembly of the device.

A resilient ring 30 is provided between the head of the bolt 20 and the mounting plate 12. An inside washer 32 fits between the head of the bolt 20 and the ring 30 to provide a greater surface area at the head of the bolt 20 upon which the ring 30 may act. The ring 30 may be a rubber ring such as is known to those skilled in the mechanical arts or, alternatively, it may be constructed of any other resilient material so long as it has the requisite elastic properties to accomplish the purposes of the flexible mounting means 16 as herein described.

A shroud 26 is provided having holes 28 in its lower portion and holes 58 in its upper portion. The holes 28, 58 in the shroud 26 are elongated so that the shroud 26 may be used with several variations of four-hole, rectangularly shaped bolt patterns. The shroud 26 is preferably constructed of a polymeric material which provides for inexpensive mass production, but it will be appreciated that the shroud 26 may be made from several different types of materials so long as they are sufficiently resistant to the demands of harsh weather conditions. The shroud 26 is positioned between the mounting plate 12 of the goal 10 and the backboard 14. The holes 28 in the lower portion of the shroud 26 correspond with the holes 24 in the mounting plate 12 and the holes 22 in the backboard 14. Thus, the shroud 26 is positioned between the mounting plate 12 and the backboard 14 by extending the bolt 20 through the hole 24 in the mounting plate 12, the hole 28 in the shroud 26 and the hole 22 in the rigid support member 14.

A T-nut 34 having a sleeve 36 and a flange 38 is threaded onto bolt 20 and is positioned on the bolt 20 between the mounting plate 12 and the shroud 26. The sleeve 36 of T-nut 34 extends through the hole 24 in the mounting plate 12 and inside the ring 30. Thus, when fully assembled, the ring 30 fits over the sleeve 36 of T-nut 34, and the flange 38 of T-nut 34 operates to hold the shroud 26 firmly against the backboard 14.

An outside washer 40 and a lock washer 42 fit over the end of bolt 20 and are held firmly against the backboard 14 by a nut 44 which is threaded on the end of bolt 20 and tightened. As the nut 44 is tightened, the mounting plate 12, the flange 38 of T-nut 34, the shroud 26, and the backboard 14 are tightened together so that the goal 10 is secured at its lower portion to the backboard 14.

The nut 44 must be tightened to provide a substantial amount of compression on the ring 30 so that the goal 10 is mounted with sufficient force against the backboard 14 that when the goal 10 is hit by a basketball during normal use, it remains rigid. However, the amount of compression on ring 30 should not be so great that the mounting plate 12 will not be able to pivot about a movable point near the lower portion of mounting plate 12 when the goal 10 is broken away from the backboard 14 as will be explained below.

In one embodiment, the biased mounting means 18 utilize a U-shaped bolt 51. The U-shaped bolt 51 is used to secure the upper portion of the mounting plate 12 to the backboard 14. Each of the legs 53 of the U-shaped bolt 51 fits through a pivot hole 74 of a mounting bracket 73 (shown in FIG. 3), an upper mounting hole 52 on the backboard 14, an upper hole 54 on the mounting plate 12, and through a hole 58 in the upper portion of the shroud 26. As previously stated, the holes 58 in the shroud 26 are elongated such that the shroud 26 may fit the various bolt patterns of the mounting plates 12 and rigid support members 14 used by different manufacturers of basketball goals and backboards.

Figure 1A:
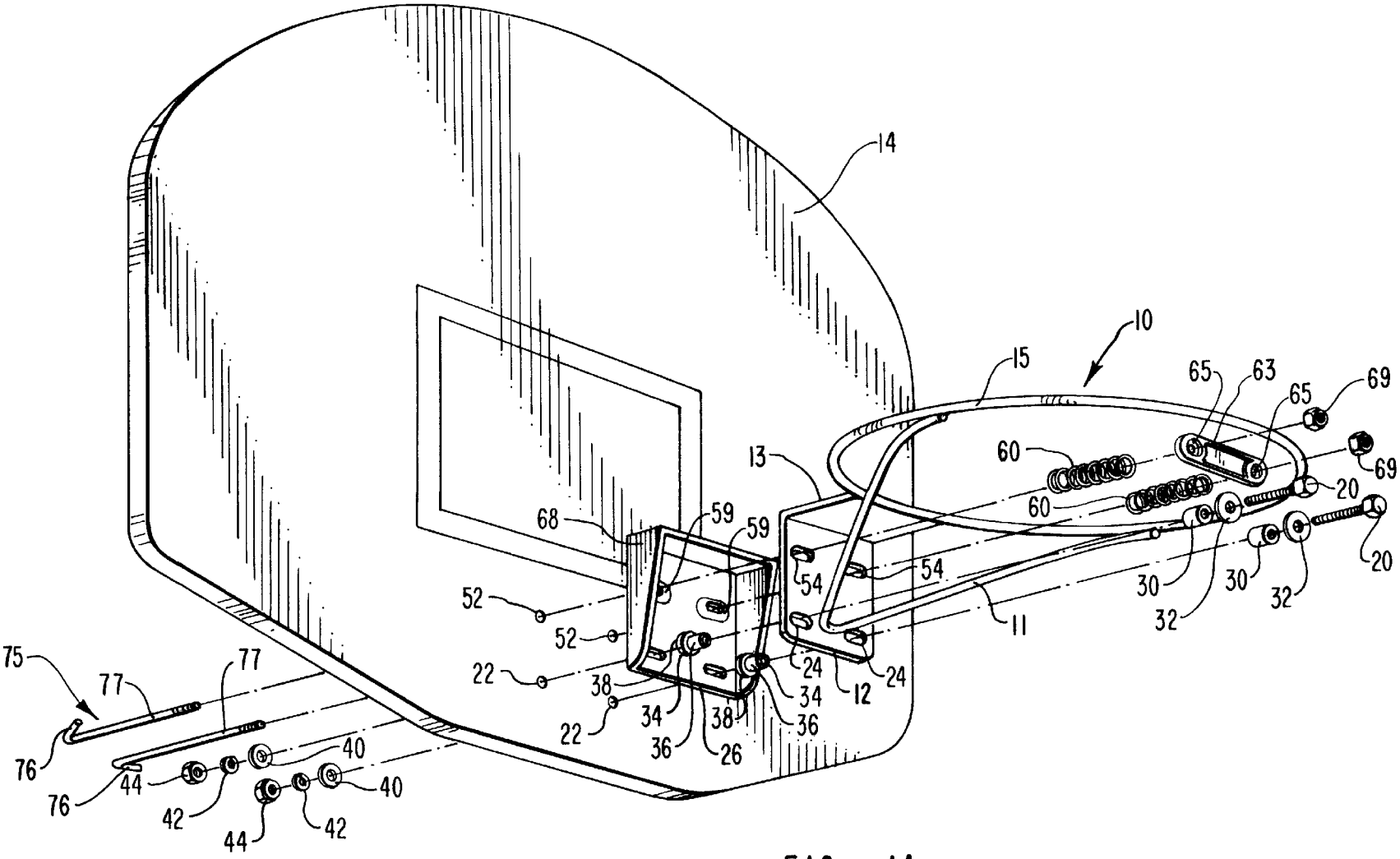
FIG. 1A is an exploded perspective view of the present invention showing the disposition of various components including a pair of J-shaped bolts used for flexibly mounting a standard basketball goal to a conventional backboard.

In an alternate embodiment, the U-shaped bolt 51 is replaced with a pair of J-shaped bolts 75 as shown in FIG. 1A. The J-shaped bolts 75 function in essentially the same manner as the U-shaped bolt 51 of FIG. 1. Thus, each J-shaped bolt is likewise fitted through the pivot hole 74 of the mounting bracket 73, the upper mounting hold 52 of the backboard 14, the upper hole 54 at the mounting plate 12, and the hole 58 in the upper portion of the shroud 26.

The J-shaped bolts 75 may be more suited for certain configurations of basketball goals than the U-shaped bolts 51. For instance, it may be easier to pass the J-shaped bolts 75 individually through the pivot holes 74 of the mounting bracket 73 as shown in FIG. 3A than to install a U-shaped bolt 51 through the pair of pivot holes 74.

Figure 3:
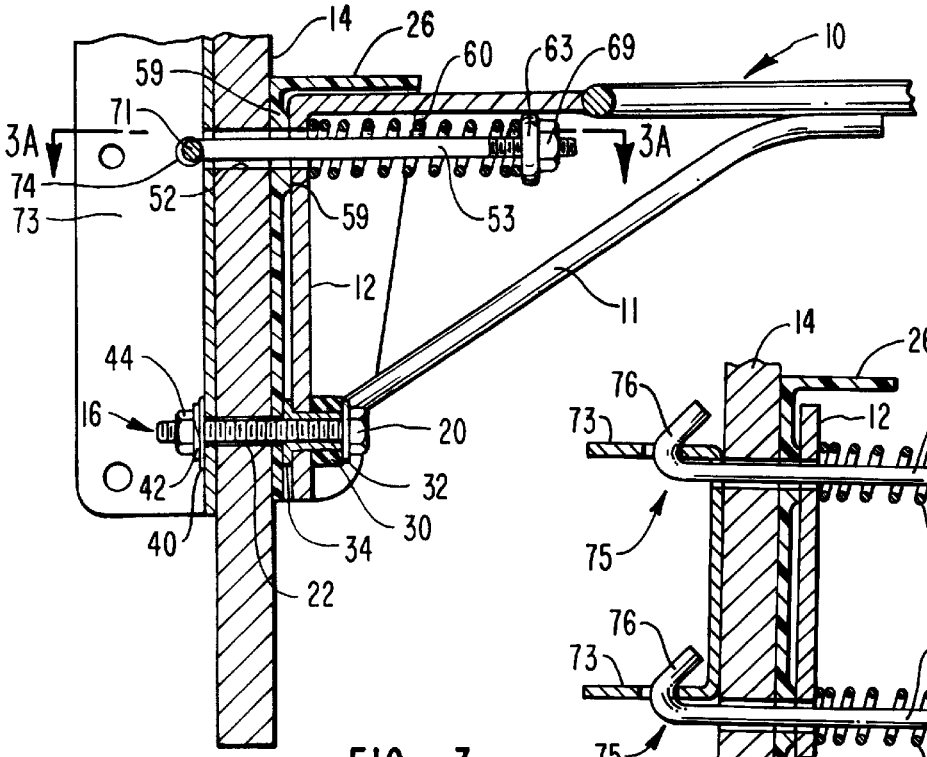
FIG. 3 is a sectional view of a cut-away of the basketball goal and backboard of FIG. 2 taken along line 3—3.
Figure 3A:
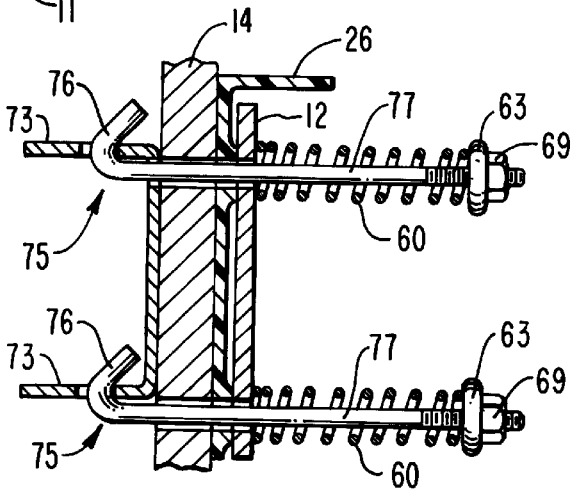
FIG. 3A is a sectional top view of a cut away of the basketball goal and backboard similar to that in FIG. 3 illustrating the use of a pair of J-shaped hooks for flexibly mounting the basketball goal of FIG. 3 to a backboard.

The J-shaped bolts 75 also provide greater flexibility, as they are capable of facing outward, as shown in FIG. 1A or facing inward as shown by the bottom-most of J-shaped bolts 75 of FIG. 3. The J-shaped bolts 75 may also face in a combination of inward and outward directions as shown in FIG. 3A. This flexibility facilitates even easier installation and greater compatibility with different configurations of backboards.

Referring back to FIG. 1, a bias means is provided on each of the J-shaped bolts 72 or on each leg 53 of the U-shaped bolt 51 such that, when assembled, the upper portion of the mounting plate 12 is biased against the shroud 26 and the backboard 14. While the bias means may comprise any one of a number of mechanical apparatus such that the requisite biasing is performed, it is presently preferred that the bias means comprise a helical spring 60 as illustrated in FIG. 1. Each spring 60 surrounds the shaft of one of the J-shaped bolts 72 or one of the legs 53 of the U-shaped bolt 51 and is held in position by an inside washer (not shown) or a spacer 63. The spacer 63 serves to maintain a distance between each of the J-shaped bolts 72 or the legs 53. The spacer 63 has an annular track 65 against which the spring 60 rests. The spring 60, in the presently preferred embodiment of the invention, is manufactured such that it is substantially flat at each end. Therefore, it may seat against the annular track 65 of the spacer 63. Therefore, the spring 60 is held in a position concentric with the J-shaped bolt 72 or the leg 53 by the spacer 63.

Figure 4:
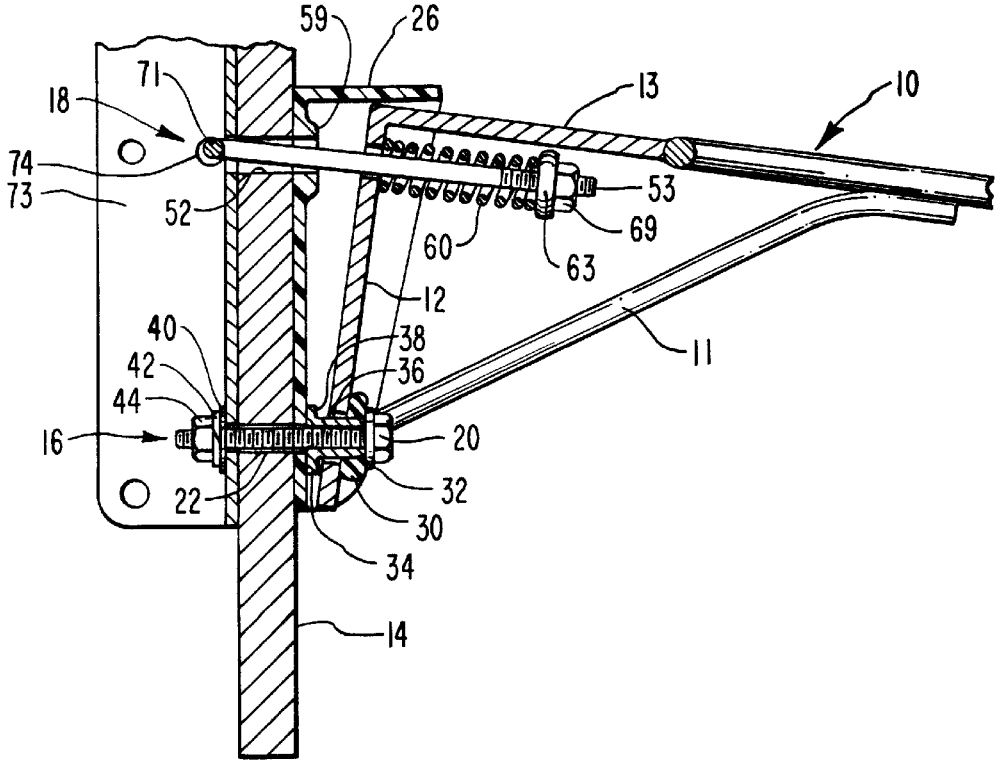
FIG. 4 is a sectional view similar to that illustrated in FIG. 3 showing the present invention in a slightly broken-away position.

The shroud 26 is further configured such that nubs 59 are located around the upper holes 58 of the shroud 26 as can be seen by reference to FIG. 4. The depth of the nubs 59 should be approximately the same width as the depth of the flange 38 on the T-nut 34 used to secure the lower portion of mounting plate 12 to backboard 14. The nubs 59 are provided so that the mounting plate 12 is mounted equidistant from the backboard 14. This ensures that the mounting plate 12 will be mounted in a substantially vertical position thereby ensuring that the goal 10 will be mounted in a substantially horizontal position as is desirable when mounting a basketball goal 10.

Nuts 69 are provided for threaded engagement on the U-shaped bolt 51. By tightening each nut 69 on the U-shaped bolt 51, the upper portion of the mounting plate 12, the shroud 26, and the backboard 14 are firmly mounted together. It will be appreciated that the further the nut 69 is tightened on the U-shaped bolt 51, the greater amount the spring 60 will be compressed. It is the force which the spring 60 exerts on the mounting plate 12 which determines how firmly the goal 10 will be mounted to the backboard 14 at the upper portion of the mounting plate 12.

With the goal 10 mounted to the backboard 14 as described above, the threshold force may be adjusted as desired. In operation, it is desirable that the goal 10 remain rigidly disposed in a substantially horizontal position during regular use. Because during regular use the goal 10 is subject to several different forces, such as those caused by the basketball striking the goal or by players inadvertently hitting the goal, the goal 10 must be secured with sufficient force against the backboard 14 to not break away during regular use. This is accomplished by tightening the nut 69 to slightly compress the spring 60. Because the force which the spring 60 exerts against the mounting plate 12 when compressed is directly proportional to the degree of compression of the spring 60, the nut 69 may be tightened on the U-shaped bolt 51 until the goal 10 stays mounted in a rigid position during normal play.

As was mentioned above, when assembling the present invention, the spring 60 is initially compressed so it biases the mounting plate 12 against the backboard 14 with sufficient force that the mounting plate 12 remains substantially rigidly secured to the backboard 14 during conditions of regular use. Therefore, to break the goal 10 away from the backboard 14, the spring 60 must be compressed further to allow break away. Thus, the threshold force—the force which, when applied to goal 10, results in breaking away of the goal 10 from the backboard 14—may be adjusted by changing the amount that the spring 60 is compressed when the mounting apparatus of the present invention is assembled.

It will be appreciated that the spring 60 must be stiff enough so that when the spring 60 is slightly compressed at the time the mounting apparatus is assembled, a sufficient biasing force will be applied to the mounting plate 12 to keep it biased against the backboard 14 during regular use. Additionally, if the spring constant of the spring 60 is too low, when a substantial force is imparted to the goal 10, causing the goal 10 to break away from the backboard 14 by further compressing the spring 60, the spring 60 will quickly become fully compressed. If the spring 60 becomes fully compressed, then the energy transferred to the goal from the impact of a force applied to the goal 10 is not dissipated by the spring 60 and the advantages of the present invention are not realized. Alternatively, if the spring constant of the spring 60 is too high, the energy transferred to the goal 10 from the impact of a substantial force applied to the goal 10 would not be dissipated by the spring 60 because the spring 60 would be so stiff it would be substantially rigid, and the impact of the force applied to the goal 10 may damage the goal 10 and/or backboard 14.

In operation, if someone dunks the basketball or hangs from the rim 15, a substantial force may be applied to the goal 10. If that force is greater than the threshold force, then the resulting forces acting on the mounting plate 12 of the goal 10 will cause the mounting plate 12 to pivot about a movable point at the lower portion of the mounting plate 12 near the holes 24 in the mounting plate 12.

When someone dunks the basketball, the force applied to the goal 10 will vary each time. Thus, forces are applied to the goal 10 in both vertical and horizontal directions. When the goal 10 deflects away from the backboard 14, the pivot point at the lower portion of the mounting plate 12 varies according to the direction of the application of the force. When the force applied to the goal 10 exceeds the threshold force, the upper portion of the mounting plate 12 near the holes 54 will deflect away from the backboard 14 along a substantially arcuate path about the pivot point as described above. As the upper portion of the mounting plate 12 deflects away from the backboard 14, the springs 60 on the biased mounting means 18 will compress, thereby allowing the upper portion of the mounting plate 12 to deflect away from the backboard 14. As the springs 60 are compressed, the act of compressing the springs 60 absorbs much of the energy applied to the goal 10 from the impact of the exerted force. As the upper portion of the mounting plate 12 separates from the backboard 14 by compressing the springs 60, the lower portion of the mounting plate 12 pivots about a movable point near the holes 24 by compressing the rings 30. The rings 30 provide sufficient flexibility to allow the lower portion of the mounting plate 12 to pivot, thereby allowing the goal 10 to break away from the backboard 14.

When the goal 10 breaks away from the backboard 14, the upper portion of the mounting plate 12 separates from the backboard 14 thereby creating a space between the goal 10 and the backboard 14. To reduce risk of harm, extending panels 68 on the shroud 26 are provided to shield the space as can be seen in FIG. 1. The extending panels 68 cover both sides and the top of the space created when the goal 10 is broken away from the backboard 14.

As can be seen in FIG. 4, when the basketball goal 10 is in the broken-away position, the goal 10 breaks away along an arcuate path which could stress or bend a rigidly secured bolt. Thus, the U-shaped bolt 51 or the J-shaped bolts 75, whichever is being used, is pivotally mounted in the pivot holes 74 of the mounting bracket 73. The upper mounting hole 52 in the backboard 14 may be elongated in a vertical direction as illustrated in FIGS. 3 and 4 or oversized so that as the goal 10 is broken away from the backboard 14, the J-shaped bolts 75 or the legs 53 of the U-shaped bolt 51 may deflect in a clockwise direction as viewed in FIG. 4 without bending.

The present invention may be embodied in other specific forms without departing from its spirit or essential characteristics. The described embodiment is thus to be considered in all respects only as illustrative and not restrictive. The scope of the invention is, therefore, indicated by the appended claims rather than by the foregoing description. All modifications or changes which come within the meaning and range of equivalency of the claims are to be embraced within their scope.

What is claimed and desired to be secured by United States Letters Patent is:

1. An apparatus for flexibly mounting a basketball goal to a rigid support member whereby the goal retractably breaks away from the rigid support member if a force exceeding a threshold force is applied to the goal, the basketball goal having a rim and a mounting plate disposed perpendicular to the plane of the rim and having an upper portion and a lower portion, comprising:

at least one flexible mounting means disposed near the lower portion of the mounting plate and securing the lower portion of the mounting plate in flexible connection to the rigid support member, said flexible mounting means being configured to permit pivoting of the goal away from the rigid support member about a point near the lower portion of the mounting plate if a force exceeding the threshold force is applied to the goal; and a biased mounting assembly disposed near the upper portion of the mounting plate and securing the upper portion of the mounting plate in biased abutment to the rigid support member, said biased mounting assembly being connected to the rigid support member in pivotal engagement to permit the upper portion of the mounting plate to separate from the rigid support member along a substantially arc-shaped path as the goal pivots about the point near the lower portion of the mounting plate if a force exceeding the threshold force is applied to the goal, said biased mounting assembly comprising a shaft having at least one leg and an integral pivot portion extending in a direction substantially perpendicular to said leg, a nut, and a biasing member, wherein said shaft is pivotally mounted to said rigid support member with said pivot portion such that said shaft pivots about said pivot portion, and said nut threads to said shaft and secures said biasing member in abutment with the mounting plate.

2. An apparatus for flexibly mounting a basketball goal to a rigid support member as defined in claim 1, wherein said shaft comprises one leg of a U-shaped bolt, the U-shaped bolt having two legs and a butt portion substantially perpendicular to each of the legs and connected at either end to one of the legs, said integral pivot portion being part of said butt portion.

3. An apparatus for flexibly mounting a basketball goal to a rigid support member as defined in claim 1, wherein said shaft comprises a J-shaped bolt having a leg and a hooked portion at one side of said leg said integral pivot portion being part of said hooked portion.

4. An apparatus for flexibly mounting a basketball goal to a rigid support member as defined in claim 2, wherein said biased mounting assembly further comprises a spacer plate, said spacer plate being disposed between said nut and said biasing member and spanning between each leg of said U-shaped bolt to maintain said legs in a spaced relationship to each other.

5. An apparatus for flexibly mounting a basketball goal to a rigid support member as defined in claim 3, further comprising a second J-shaped bolt and a second nut, said second nut threading to said second J-shaped bolt and securing said biasing in abutment with the mounting plate, wherein said biased mounting assembly further comprises a spacer plate, said spacer plate being disposed between said first nut and said biasing member and said second nut and said biasing member and spanning between each of said J-shaped bolts to maintain said J-shaped bolts in a spaced relationship to each other.

6. An apparatus for flexibly mounting a basketball goal to a rigid support member as defined in claim 1, wherein said biasing member comprises a spring, said spring being disposed about said shaft and secured in abutment with the upper portion of the mounting plate by said nut.

7. An apparatus for flexibly mounting a basketball goal to a rigid support member as defined in claim 1, further comprising a second shaft, a second nut and a pair of springs, each of said springs being disposed about one of said shaft, and secured in abutment with the upper portion of the mounting plate by one of said nuts.

8. An apparatus for flexibly mounting a basketball goal to a rigid support member as defined in claim 1, wherein said biased mounting assembly further comprises a spacer plate, said spacer plate being disposed between said nut and said biasing member.

9. An apparatus for flexibly mounting a basketball goal to a rigid support member as defined in claim 8, wherein said biasing member comprises a spring, said spring being disposed about said shaft and secured in abutment with the upper portion of the mounting plate by said nut.

10. An apparatus for flexibly mounting a basketball goal to a rigid support member as defined in claim 9, wherein said spacer plate further comprises centering means for maintaining said spring in a concentric disposition surrounding the longitudinal axis of said shaft.

11. An apparatus for flexibly mounting a basketball goal to a rigid support member as defined in claim 10, wherein said centering means comprises an annular track.

12. An apparatus for flexibly mounting a basketball goal to a rigid support member as defined in claim 1, further comprising a shroud connected between the mounting plate and the rigid support member, the shroud having extending panels which shields the space between the mounting plate and the rigid support member if the goal breaks away from the rigid support.

13. An apparatus for flexibly mounting a basketball goal to a rigid support member as defined in claim 12, further comprising a T-nut assembly having a T-nut which secures said shroud between the rigid support member and said T-nut.

14. An apparatus for flexibly mounting a basketball goal to a rigid support member as defined in claim 1, further comprising a bracket connected with the rigid support member and having a support portion extending outward from the rear of said rigid support member in a direction substantially perpendicular to the mounting plate, said support portion having a hole therein within which said pivot portion is pivotally disposed.

15. An apparatus for flexibly mounting a basketball goal to a rigid support member whereby the goal retractably breaks away from the rigid support member if a force exceeding a threshold force is applied to the goal, the basketball goal having a rim and a mounting plate disposed perpendicular to the plane of the rim and having an upper portion and a lower portion, comprising:

a bracket connected to said rigid support member and having a support portion extending outward from the rear of the the rigid support member in a direction perpendicular to the mounting plate, said support portion of said bracket comprising a hole therein;

at least one flexible mounting means disposed near the lower portion of the mounting plate and securing the lower portion of the mounting plate in flexible connection to the rigid support member, said flexible mounting means being configured to permit pivoting of the goal away from the rigid support member about a point near the lower portion of the mounting plate if a force exceeding the threshold force is applied to the goal; and a biased mounting assembly disposed near the upper portion of the mounting plate and securing the upper portion of the mounting plate in biased abutment to the rigid support member, said biased mounting assembly being connected to said bracket in pivotal engagement to permit the upper portion of the mounting plate to separate from the rigid support member along a substantially arc-shaped path as the goal pivots about the point near the lower portion of the mounting plate if a force exceeding the threshold force is applied to the goal, said biased mounting assembly comprising a shaft having a leg and an integral pivot portion extending in a direction substantially perpendicular to the leg, a nut, and a biasing member, wherein said shaft is pivotally mounted to said bracket by said pivot portion which is pivotally disposed within said hole and said nut threads to said shaft and secures said biasing member in abutment with the mounting plate.

16. An apparatus for flexibly mounting a basketball goal to a rigid support member as defined in claim 15, wherein the shaft comprises a U-shaped bolt having a butt portion and a pair of legs, said butt portion being disposed within said hole such that the legs of the U-shaped bolt pivot about the longitudinal axis of the butt portion of the U-shaped bolt, said integral pivot porion being part of said butt portion.

17. An apparatus for flexibly mounting a basketball goal to a rigid support member as defined in claim 16, wherein said biasing member comprises a pair of springs, each of said springs being disposed about a leg of said U-shaped bolt and secured in abutment with the upper portion of the mounting plate by one of said nuts.

18. An apparatus for flexibly mounting a basketball goal to a rigid support member as defined in claim 15, wherein said biased mounting assembly further comprises a spacer plate, said spacer plate being disposed between said nuts and biasing members and spanning between each leg of the pair of legs of said shaft to maintain said legs in spaced relationship to each other.

19. An apparatus for flexibly mounting a basketball goal to a rigid support member as defined in claim 18, wherein said biasing member comprises a spring, said spring being disposed about said shaft and secured in abutment with the upper portion of the mounting plate by said nut.

20. An apparatus for flexibly mounting a basketball goal to a rigid support member as defined in claim 19, wherein said spacer plate further comprises centering means for maintaining said spring in a concentric disposition surrounding the longitudinal axis of said shaft.

21. An apparatus for flexibly mounting a basketball goal to a rigid support member as defined in claim 20, wherein said centering means comprises an annular track.

22. An apparatus for flexibly mounting a basketball goal to a rigid support member as defined in claim 15, further comprising a shroud connected between the mounting plate and the rigid support member, the shroud having extending panels which shields the space between the mounting plate and the rigid support member if the goal breaks away from the rigid support.

23. An apparatus for flexibly mounting a basketball goal to a rigid support member as defined in claim 22, further comprising a T-nut assembly having a T-nut which secures said shroud between the rigid support member and said T-nut.

24. An apparatus for flexibly mounting a basketball goal to a rigid support member as defined in claim 15, wherein said shaft comprises a J-shaped bolt having a leg and a hook portion at one side of said leg, said integral pivot portion being of said hook portion.

* * * * *

UNITED STATES PATENT AND TRADEMARK OFFICE

CERTIFICATE OF CORRECTION

PATENT NO : 5,816,955
DATED : October 6, 1998
INVENTOR(S) : Richard C. Nordgran et al.

It is certified that errors appear in the above-identified patent and that said Letters Patent is hereby corrected as shown below:

Column 14, line 8, following "being", insert --part--.

Signed and Sealed this

Twenty-seventh Day of April, 1999

*Attest:*

Q. TODD DICKINSON

*Attesting Officer*

*Acting Commissioner of Patents and Trademarks*